US006493522B2

(12) United States Patent
Fujita

(10) Patent No.: US 6,493,522 B2
(45) Date of Patent: Dec. 10, 2002

(54) DEVELOPING DEVICE AND IMAGE FORMING APPARATUS

(75) Inventor: Hideki Fujita, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/875,014

(22) Filed: Jun. 7, 2001

(65) Prior Publication Data

US 2002/0037174 A1 Mar. 28, 2002

(30) Foreign Application Priority Data

Jun. 9, 2000 (JP) ..... 2000-174485

(51) Int. Cl.[7] ..... G03G 15/00
(52) U.S. Cl. ..... 399/44; 399/53; 399/82
(58) Field of Search ..... 399/44, 53, 265, 399/267, 274, 279, 284, 82

(56) References Cited

U.S. PATENT DOCUMENTS

| | | | | |
|---|---|---|---|---|
| 2,221,776 A | | 11/1940 | Carlson | 95/5 |
| 2,297,691 A | | 10/1942 | Carlson | 95/5 |
| 2,874,063 A | | 2/1959 | Greig | 117/17.5 |
| 4,935,779 A | * | 6/1990 | Sawada | 399/209 |

FOREIGN PATENT DOCUMENTS

| | | | |
|---|---|---|---|
| JP | 42-23910 | | 11/1942 |
| JP | 43-24748 | | 10/1943 |
| JP | 54-60932 | * | 5/1979 |
| JP | 1-62670 | * | 3/1989 |
| JP | 2-281271 | * | 11/1990 |
| JP | 4-34471 | * | 2/1992 |
| JP | 7-168436 | * | 7/1995 |
| JP | 10-90995 | * | 4/1998 |
| JP | 2000-267365 | * | 9/2000 |
| JP | 2001-42635 | * | 2/2001 |
| JP | 2001-134066 | * | 5/2001 |

* cited by examiner

*Primary Examiner*—Quana M. Grainger
(74) *Attorney, Agent, or Firm*—Fitzpatrick, Cella, Harper & Scinto

(57) ABSTRACT

An image forming apparatus includes a developer bearing member for bearing and transporting a developer to enable development of a latent image formed on an image bearing member. A regulating member regulates the thickness of a layer of the developer borne on the developer bearing member. A fixing device fixes a developer image on a recording medium transferred from the image bearing member. One of a first mode in which a developer image is formed only on one side of a recording medium and a second mode in which developer images are formed on two sides of a recording medium can be selected. The image forming apparatus also includes a controller for controlling the peripheral speed of the developer bearing member according to the selected mode.

21 Claims, 14 Drawing Sheets

DEVELOPING DEVICE AND IMAGE FORMING APPARATUS

BACKGROUND OF THE INVENTION

1. Field of the Invention

The present invention relates to an image forming apparatus using an electrophotographic process and to a developing device used in the image forming apparatus. More particularly, the present invention relates to an image forming apparatus such as a copying machine, a printer, or a facsimile machine, and to a developing device used in the image forming apparatus.

2. Related Background Art

In recent years, many image processing apparatuses have been proposed as a hardware unit for digital information communication through a data communication network and for outputting digital information.

This kind of apparatus comprises a copying machine, a printer and a facsimile machine.

FIG. 9 is a diagram schematically showing essential portions of a digital printer, which is an example of this kind of conventional image forming apparatus.

A photosensitive drum 1 provided as an image bearing member is formed of a cylindrical electroconductive base member and a photoconductive layer formed on the base member, and is supported so as to be rotatable in the direction indicated by the arrow A in FIG. 9.

Around the photosensitive drum 1 are successively disposed, along the direction indicated by the arrow A, a primary charger 2 which uniformly charges the surface of the photosensitive drum 1, an exposing device 3 which reads an original to obtain an image signal according to the density of an image and exposes the photosensitive drum 1 on the basis of the image signal to form an electrostatic latent image, a developing device 4 which attaches toner (developer) to the electrostatic latent image to form a toner image (developed image), a transfer-separation charger 5 which transfers the toner image formed on the photosensitive drum 1 onto a sheet S and separates from the photosensitive drum 1 the sheet S having the transferred toner image on its surface, a cleaning device 6 which removes residual toner on the photosensitive drum 1 after transfer of the toner image, and a pre-exposing device 7 which eliminates residual charge on the photosensitive drum 1.

Sheet S having the transferred image on its surface is transported to a fixing device 8 after being separated from the photosensitive drum 1. In the fixing device 8, the toner image on the surface of sheet S is fixed and the desired printed image is formed by image forming means to be delivered to a place outside the image forming apparatus.

In a reader unit 91, an original placed on an original glass stand 911 is irradiated with light emitted from an illumination lamp 912, and reflected light from the original is imaged on a single-line photoelectric element array 913 provided as a photoelectric conversion element to be converted into an electrical signal in accordance with image information. Reflected light from the original irradiated with light from the illumination lamp 912 is guided by mirrors 914*a* and 914*b* and imaged on the photoelectric conversion device 913 by a lens 916. The electrical signal output from the photoelectric conversion device 913 undergoes analog to digital conversion in an analog to digital (A/D) converter 915 to be converted into an 8-bit digital image data. This image data undergoes logarithmic conversion in a black signal generation circuit 917 to convert luminance information into density information, thereby obtaining image density data.

Eight-bit digital image data formed as described above is supplied to a laser drive circuit 301, which is a well-known pulse-width modulation (PWM) circuit. The drive circuit 301 modulates the emission time of a semiconductor laser 304 according to the supplied image density signal so as to change the area grayscale level in each pixel area, thereby realizing a tint or tone.

Laser driving methods are generally grouped into those using a PWM circuit corresponding to that described above and those using a binary laser drive circuit. The PWM circuit modulates, according to the level of the input image density signal, a pulse width signal corresponding to the time period during which the semiconductor laser emits light, as described above. On the other hand, the binarizing circuit converts the image signal into a two-step signal consisting of particular emission-on and emission off signals and inputs this two-step signal to the laser drive circuit 301, thereby turning on and off the semiconductor laser device 304.

Laser light emitted by the above-described laser driving according to the image signal is led to the photosensitive drum 1 by a polygon mirror scanner 302 rotating at a high speed and by a mirror 303 to perform raster scan writing on the photosensitive drum 1, thereby forming a digital electrostatic latent image as image information.

A number of electrophotographic methods, including the inventions patented as U.S. Pat. No. 2,297,961, Japanese Patent Publication (Kokoku) Nos. 42-23910 and 43-24748, etc., are known. Ordinarily, an electrical latent image is formed by one of various available means on a photosensitive drum provided as a recording medium using a photoelectric material and is developed by using toner (developer), and the obtained toner image is transferred onto a recording member such as paper selected as desired and is fixed on the recording member by heating or processing using a solvent vapor or the like to produce an image output.

Also, various development methods for visualizing an electric latent image by using a developer are known, which are, for example, magnetic brush development methods relating to U.S. Pat. No. 2,874,063, powder cloud methods relating to U.S. Pat. No. 2,221,776, fur brush development methods, and liquid development methods. In particular, among these development methods, magnetic brush development methods using a two-component developer having toner and a carrier as main components have been put into wide practical use. This kind of method makes it possible to obtain a good image with comparatively high stability, but entails drawbacks relating to the two-component developer, i.e., degradation of the carrier and variation in the toner/carrier mixture ratio.

To avoid these drawbacks, various development methods using a monocomponent developer composed of toner alone have been proposed. This kind of development method eliminates the need for control of the amount of toner with respect to the toner/carrier mixture ratio and has the advantage of simplifying the image forming apparatus.

Such a monocomponent development method is carried out in such a manner that a developer bearing member 41 of the developing device 4 is disposed so as to be opposed to the photosensitive drum 1 for bearing an electrostatic latent image in a noncontact relationship therewith, and a developing bias voltage E from a power supply 49 is applied between the developer bearing member 41 and the photosensitive drum 1 to perform development of the electrostatic latent image on the photosensitive drum (image bearing means) 1 (see FIGS. 6 and 7).

Methods which have been widely used as a method for forming a developer layer on the surface of the developer bearing member 41 to perform the above-described development are a method in which a member 43 in the form of a plate is used as a developer layer forming means and a suitable pressure "P" is applied to the member 43 to maintain the same in contact with the developer bearing member 41 (FIG. 6), and a method in which a developer layer forming member 43 is disposed with a suitable gap G1 formed between the member 43 and the developer bearing member 41 (FIG. 7) and a developer is fed to the vicinity N of the plate-shaped member 43 by rotation of the developer bearing member 41 in the direction indicated by the arrow B. The latter method is suitable for a high-speed image forming apparatus.

Ordinarily, the peripheral speed Vdahm of the developer bearing member is set higher, more specifically 1.4 to 2.2 times higher than that of the image bearing member.

Under the background of the public's increasing awareness of energy saving in recent years, the proportion of users who perform printing on only one side of toner image bearing media, i.e., printing sheets, in a conventional manner is decreasing while the proportion of users who perform printing on two sides of printing sheets is increasing.

As a dominant system for continuously performing printing on two sides of a plurality of printing sheets (which operation hereinafter referred to as "two-side continuous printing"), a system has been used in which transfer and fixation are first performed continuously on one side of each of a plurality of sheets (which operation hereinafter referred to as "one-side printing"), the sheets on which one-side printing has been performed are temporarily stacked on a stacking means 921 capable of stacking a plurality of sheets, and transfer and fixation are continuously performed on the other sides of the sheets stacked on the stacking means 921 simultaneously or approximately simultaneously with the completion of one-side printing on all the predetermined number of printing sheets or after passage of a predetermined time period (this system hereinafter referred to as "stacking system") (FIG. 14).

The above-described stacking system, however, requires a space for stacking means in or outside the image forming apparatus and requires setting of a procedure in which recording medium sheets on which one-side printing has been performed are temporarily stacked on the stacking means 921 before one-side printing on all the recording medium sheets is completed. Therefore there is a limit to the number of sheets on which two-side image formation is continuously performed on one printing instruction, and there is also a limit to the reduction in the time required for two-side image formation. For this reason, it is difficult to meet requirements recently made for a higher image formation speed as long as the above-described stacking system is used.

A system for two-side continuous printing, different from the above-described stacking system, has therefore been proposed in which continuous printing is performed on a plurality of sheets in the order of arrival at a transfer region Ztr formed between the photosensitive drum 1 and the transfer device 5 from either of a sheet feeding means such as a sheet feed cassette for feeding a sheet toward the transfer region Ztr and a surface reversing means 922 for retransporting one of the sheets having a toner image transferred onto and heat-fixed on its one surface to the transfer region Ztr after reversing the front side and the back side to enable transfer onto the other surface. (This system will hereinafter be referred to as "through-pass system") That is, the sheet having a toner image fixed on its one surface is transported to the transfer region immediately after being reversed. In this system, when two-side image formation is performed continuously on one printing instruction, either of two, or a mixture of two different kinds of sheets, i.e., one passed through the fixing device and one supplied from the feed cassette and having no transferred toner image (not passed through the fixing device), is supplied to the transfer region. In contrast with the stacking system, this through-path system is free from the above-described restrictions and makes it possible to reduce the size of the image forming apparatus and to increase the two-side image formation speed.

The above-described conventional art, however, entails a problem described below.

Image forming apparatuses based on the above-described conventional art, particularly a high-speed digital type of image forming apparatuses have a problem that deterioration of various image qualities, typically a reduction in image density occurs in the course of continuously outputting images onto two surfaces of a plurality of sheets while minimizing the distance between the sheets successively supplied (minimizing sheet feed intervals).

FIGS. 11 and 12 and Table 1, respectively, show changes in plate inner portion temperature Tdbr, image reflection density Drmax, etc., after two-side outputting of one million pages with A4-size images of a standard image proportion (6%) at a high temperature and high humidity (30° C., 80%RH, hereinafter, the same).

TABLE 1

| | | | After two-side continuous printing of one million A4 pages | | |
|---|---|---|---|---|---|
| Temperature (C.) | Humidity (% RH) | Absolute water amount (g/kg) | Drmax | Fogging (%) | Dark stripe(s) in sheet feed direction |
| 32 | 90 | 27.43 | 0.9 | 5 | Several tens noticeable |
| 30 | 80 | 21.56 | 0.98 | 5 | Several noticeable |
| 28 | 80 | 19.13 | 1.15 | 2 | One noticeable |
| 27 | 75 | 16.86 | 1.25 | 1 | One faintish |
| 30 | 50 | 13.3 | 1.3 | 1 | None |
| 25 | 60 | 11.89 | 1.35 | 0.5 | None |
| 23 | 50 | 8.74 | 1.4 | 0.5 | None |
| 30 | 20 | 5.25 | 1.48 | 1 | None |
| 20 | 15 | 2.16 | 1.5 | 1.5 | None |
| 15 | 5 | 0.52 | 1.5 | 2 | None |

A leading cause of these changes is considered to be a process in which the temperature in the vicinity of the developing device is increased by heat caused by eddy current produced by high-speed rotation of the developer bearing member 41 in a case where a magnetic field generation means is incorporated and/or by heat accumulated by successive passage through the transfer region of sheets fed for toner image transfer on the second side of the sheet after being heated by the heat-fixing device, the sheets being fed at such small intervals that the temperature of the sheet is not lowered before the sheet enters the transfer region; the temperature of the plate-shaped member 43 and the sleeve surface are thereby increased; and the developer having its layer thickness regulated (rubbed) between the plate-shaped member 43 and the development sleeve is affected by the heat, that is, degradation and a reduction in chargeability of the developer composed mainly of a resin are caused by the heat. It is also considered that as the developer takes up moisture, degradation and a reduction in chargeability of the developer occur.

It can be understood from FIGS. 11 and 12 and Table 1 that when the temperature Tdbr of the atmosphere in the apparatus or the absolute water amount ηaw in the atmosphere in the apparatus is increased, the image reflection density Drmax or the like becomes reduced and other image qualities become worse.

"Image reflection density Drmax" referred to in this specification is the average of values obtained by measuring, with a reflection densitometer, a product RD-914 (trademark) from MacBeth Corp (USA), five points in a copied image corresponding to circular original image portions having a reflection density of 1.2 and a diameter of 5 mm.

Also, "fogging" referred to in this specification is represented by a value obtained by subtracting from the reflectivity of unused paper the average of the reflectivities of measurement-object paper at nine white points after image formation, measured with a reflection densitometer, a product TC-6DS (trademark) from Tokyo Denshoku Co.

Today, with the development of network environments, etc., there is a need for further increasing the image outputting speed and the amount of copies and the above-described problem is becoming more serious.

To prevent an increase in the temperature of the plate-shaped members, a Peltier element (also called a semiconductor heat pump, a device which becomes cooler at its one side and becomes hotter of its the other side when supplied with current, and which is used for temperature compensation in a temperature-sensitive device such as a semiconductor laser) may be used. However, such a device is high-priced and requires a fan or the like for generating air flow for removing heat radiated from the high-temperature side.

In two-side printing performed with growing frequently as mentioned above, the sheet having a high temperature (e.g., 80° C.) immediately after passage through the fixing device 8, i.e., immediately after the completion of printing on the first side passes through the transfer section Ztr again without a pause or detour for cooling, and heat radiated from the sheet increases the temperature in the vicinity of the developing device.

In the through-path system, a temperature reduction effect similar to that in the case of the stacking system where the temperature of sheets having fixed toner images on the first surfaces is reduced while the sheets are accumulated on the intermediate tray cannot be expected. For this and other reasons, the sheet temperature immediately after the completion of printing on the first side is much higher than that in the system using the intermediate tray, and the increase in temperature in the vicinity of the developing device is considerably higher (FIG. 13).

Further, if the relative humidity is higher, i.e., the absolute water amount is high while the atmospheric temperature is constant, the influence on image quality (a reduction in image density) is larger (Table 1).

SUMMARY OF THE INVENTION

In view of the above-described circumstances, an object of the present invention is to provide an image forming apparatus capable of forming high-quality images on two surfaces of recording mediums with stability during a long period of time.

Other objects of the present invention will become apparent upon reading the following detailed description of the invention.

DESCRIPTION OF THE PREFERRED EMBODIMENTS

Figure 1:
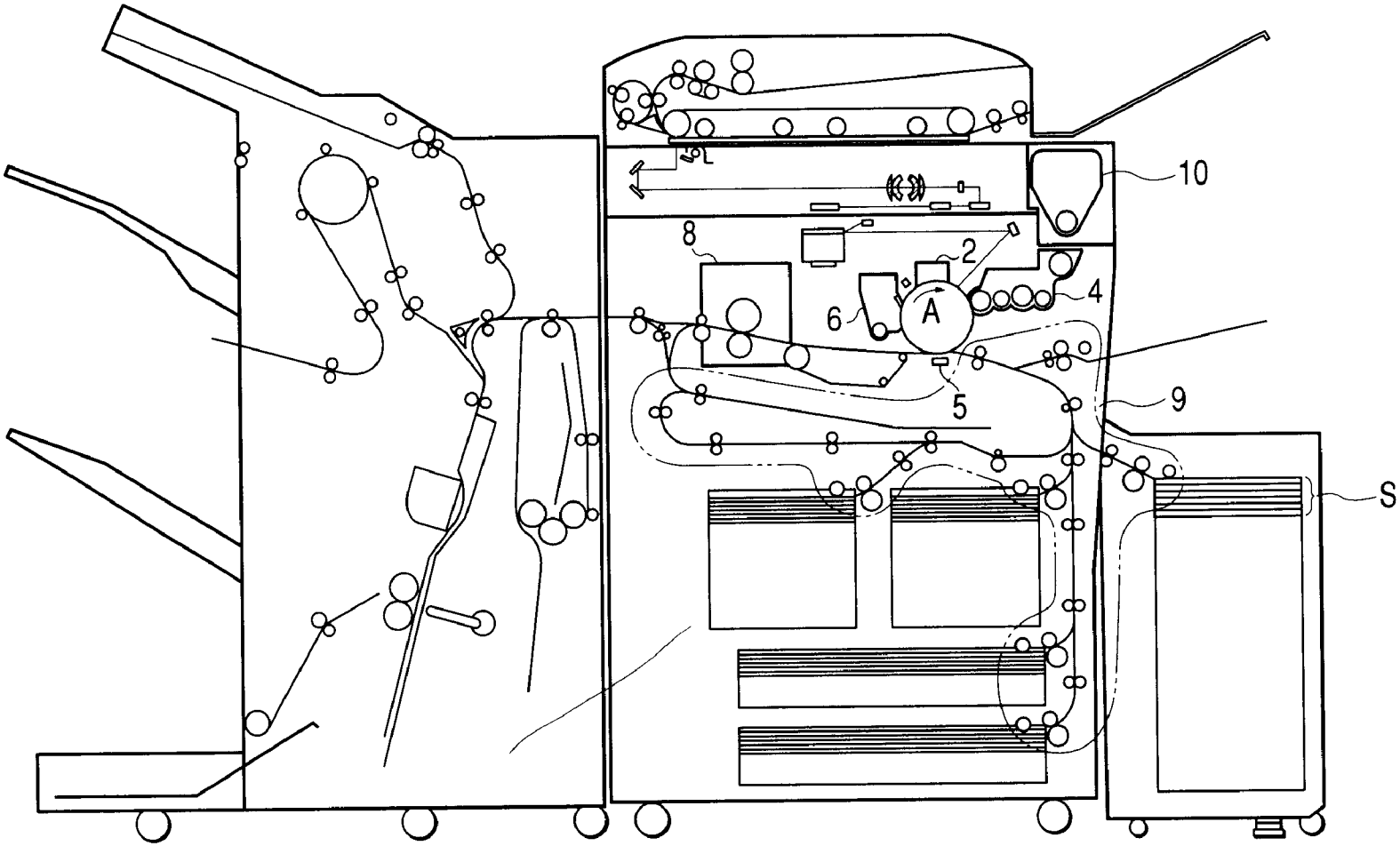
FIG. 1 is a schematic cross-sectional view of an image forming apparatus to which the present invention is applied.

Preferred embodiments of the present invention will be described in detail by way of example with reference to the accompanying drawings. The sizes, material, shapes and relative placement of components of embodiments described below should be suitably changed according to the construction of and various conditions of apparatuses to which the present invention is applied. The following description of the embodiments is not intended to limit the scope of the present invention. The constructions of image forming apparatuses in the embodiments are generally the same as that described above with respect to the conventional art. Components of the image forming apparatus of the present invention identical or corresponding to those in the conventional art are indicated by the same reference characters, and the description a them will not be repeated. The above-described through-path system is used as a two-side image forming system.

EMBODIMENT 1

FIG. 1 schematically illustrates an image forming apparatus in accordance with the present invention.

The image forming apparatus uses a drum-shaped image bearing member, i.e., an a-Si (amorphous silicon) photosensitive drum 1 having an outside diameter of 108 mm. The image forming apparatus has a process speed of 450 mm/sec, an A4 print one-side output speed of 85 pages per minute, and a two-side output speed of 85 pages per minute.

Amorphous silicon (a-Si) has a relative permittivity of about 10, which is higher than that of organic photoconductors (OPCs), and a charge potential lower than that of OPCs and is not capable of maintaining a sufficiently high latent image potential in comparison with OPCs. However, a-Si is superior in durability and has a life of three million pages or more. Therefore it is suitable for a high-speed machine.

This photosensitive member is uniformly charged to about +400 V by a primary charger 2 and then undergoes image exposure at a density of 600 dpi.

Image exposure is performed by using a semiconductor laser 303 as a light source so that the surface potential of the exposed portion decays to, for example, +50 V, thereby forming a latent image. The wavelength of exposure light is 680 nm.

Reflected light from an original imaged on a CCD of a scanner undergoes A/D conversion to be converted into a luminance signal representing an image having a density of 600 dpi and 8 bits=256 grayscale levels. This signal is supplied to an image processor unit (not shown). In the image processor unit, well-known luminance-density conversion (logarithmic conversion) is performed to convert the luminance signal into a density signal. If necessary, this image signal is processed by filtering processing for edge enhancement, smoothing, removal of high-frequency components, etc., and is processed by density correction processing (a so-called $\gamma$ conversion). The image signal is then binarized (into dots) by a binarization process such as an error diffusion process or a screening process using a clustered dot ordered dither matrix.

Thereafter, the image signal is supplied to a laser driver, which drives a laser device according to the signal (by PWM modulation if the signal is an 8-bit image signal, or by turning on and off the laser if the signal is a 1-bit image signal). Laser light from the laser device travels to the photosensitive drum 1 via a collimator lens, a polygon scanner, an fθ lens, a returning mirror, a dust-proof glass, etc., to strike the surface of the photosensitive drum 1.

The laser light forms an imaging spot on the surface of the photosensitive drum 1. The diameter of the spot is about 55 μm, slightly larger than the size of one pixel of the 600 dpi image, which is 42.3 mm. Charge on the photosensitive drum 1 is thereby eliminated to about +50 V, as mentioned above, to form an electrostatic latent image, which thereafter undergoes development.

Figure 3:
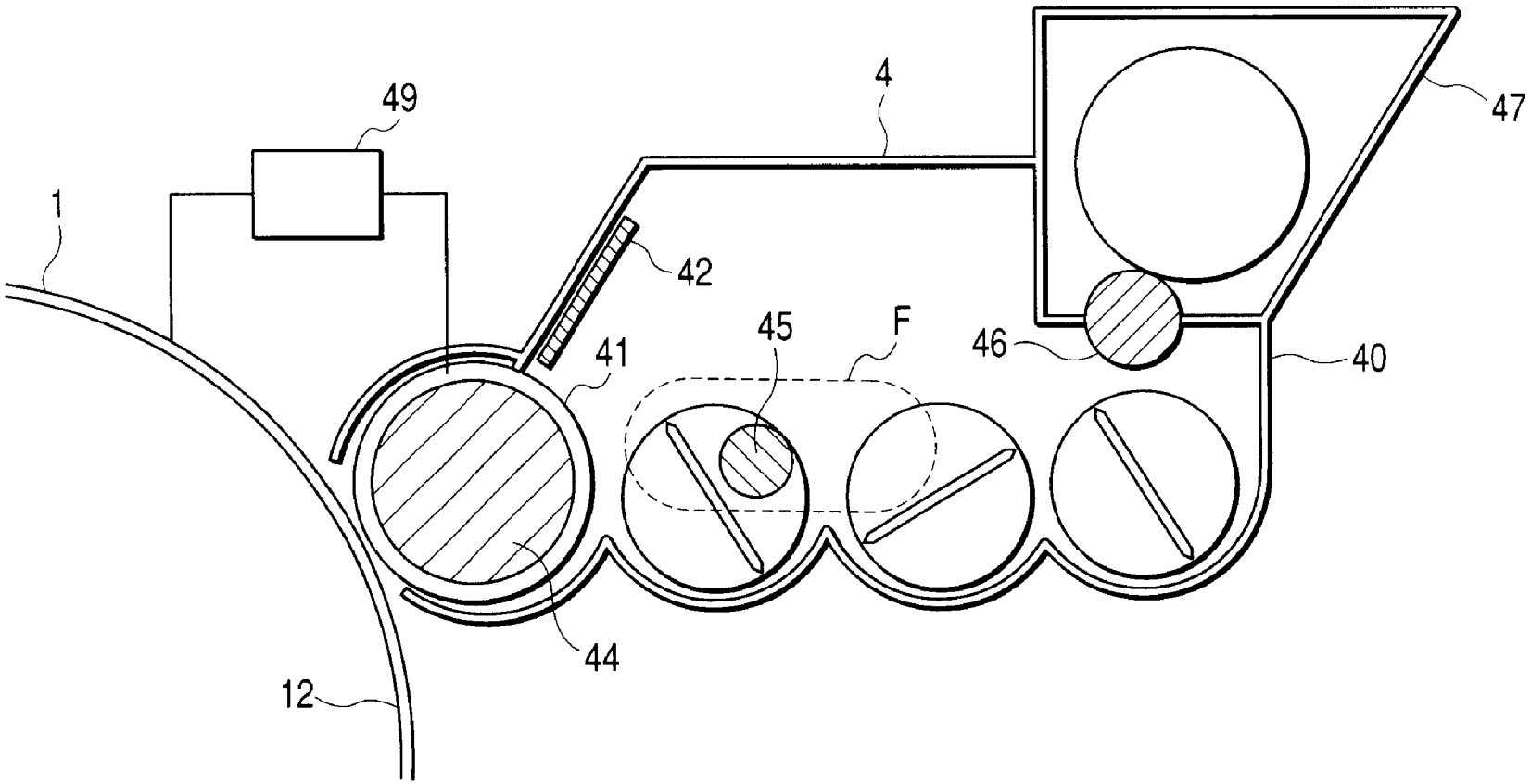
FIG. 3 is a schematic cross-sectional view of a developing device in the first embodiment of the present invention.

Supply of toner in a development device 4 is performed in such a manner that, when the amount of toner in a region F in a developer container 40 shown in FIG. 3 becomes substantially zero, a piezoelectric element 45 produces a signal such as to output a signal for rotating a magnetic roll 46, and the magnetic roll 46 is thereby rotated to supply toner from a toner buffer container 47 into the developer container 40.

The developing device 4 in this embodiment will be described below in detail.

The developing device 4 is constituted by the container 40 made of a resin, a development sleeve 41 provided as a developer bearing member, a regulating blade 42 provided as a developer regulating means, the piezoelectric element 45, and other components. About 250 g of a developer is contained in the container 40 in a normal state.

The developer used is a monocomponent magnetic toner having magnetic particles dispersed in a resin.

The toner is positively chargeable and has a weight-average particle diameter of 8.0 pm.

The size distribution of the toner may be measured by one of various known methods. For measurements in this embodiment, a counter, a product TA-II (trademark) from Coulter (USA) was used.

An electrolyte prepared by adding several drops of a surfactant to a 1% NaCl solution, a several milligrams of a test sample was dispersed by ultrasonic dispersion for several minutes. Particles having a diameter of 2 to 40 μm in the solution was counted through an aperture of 100 μm to determine the size distribution.

Ordinarily, as a binder resin for toner, styrene-based materials, such as styrene-acrylic copolymer and styrene-butadiene copolymer, a phenolic resin, polyester, etc., are used. In this embodiment, styrene-acrylic copolymer and styrene-butadiene copolymer were used in proportions of 8:2.

As a charge control agent (ordinarily added internally to toner but also capable of being externally added), nigrosine, quaternary ammonium salt, triphenylmethane, imidazole, or the like is used for positive toner.

In this embodiment, 2 parts (per hundred parts of resin component) of triphenylmethane was internally added.

In the case of toner to be heat-fixed, so-called wax is internally dispersed. For example, polyethylene, polypropylene, polyester, paraffin or the like may be added.

Since the toner in this embodiment is magnetic toner, iron oxide such as magnetite or ferrite is dispersed in the toner material. Ordinarily, the amount of added iron oxide is about 60 to 100 parts.

As agent externally added to the toner, 0.1 to 5 parts by weight of silica is mainly added externally to impart certain fluidity to the toner. This silica also has the function of reducing abrasion wear of the sleeve by being interposed between toner particles and the sleeve. The added silica also has the effect of preventing agglomeration of toner particles and promoting interchange between toner particles in contact with the sleeve and other toner particles separate from the sleeve.

Further, strontium titanate, cerium oxide, praseodymium oxide, lanthanum oxide, neodymium oxide, or the like may be externally added to the toner. Such additive acts as an abrasive agent having the effect of grinding and removing a film of toner attached to the drum.

The initial average amount of charge on the toner on the sleeve at ordinary temperature and humidity ranges from +6 to +12 μC/g and the amount of toner coating on the sleeve ranges from 0.7 to 0.9 mg/cm$^2$.

Figure 8:
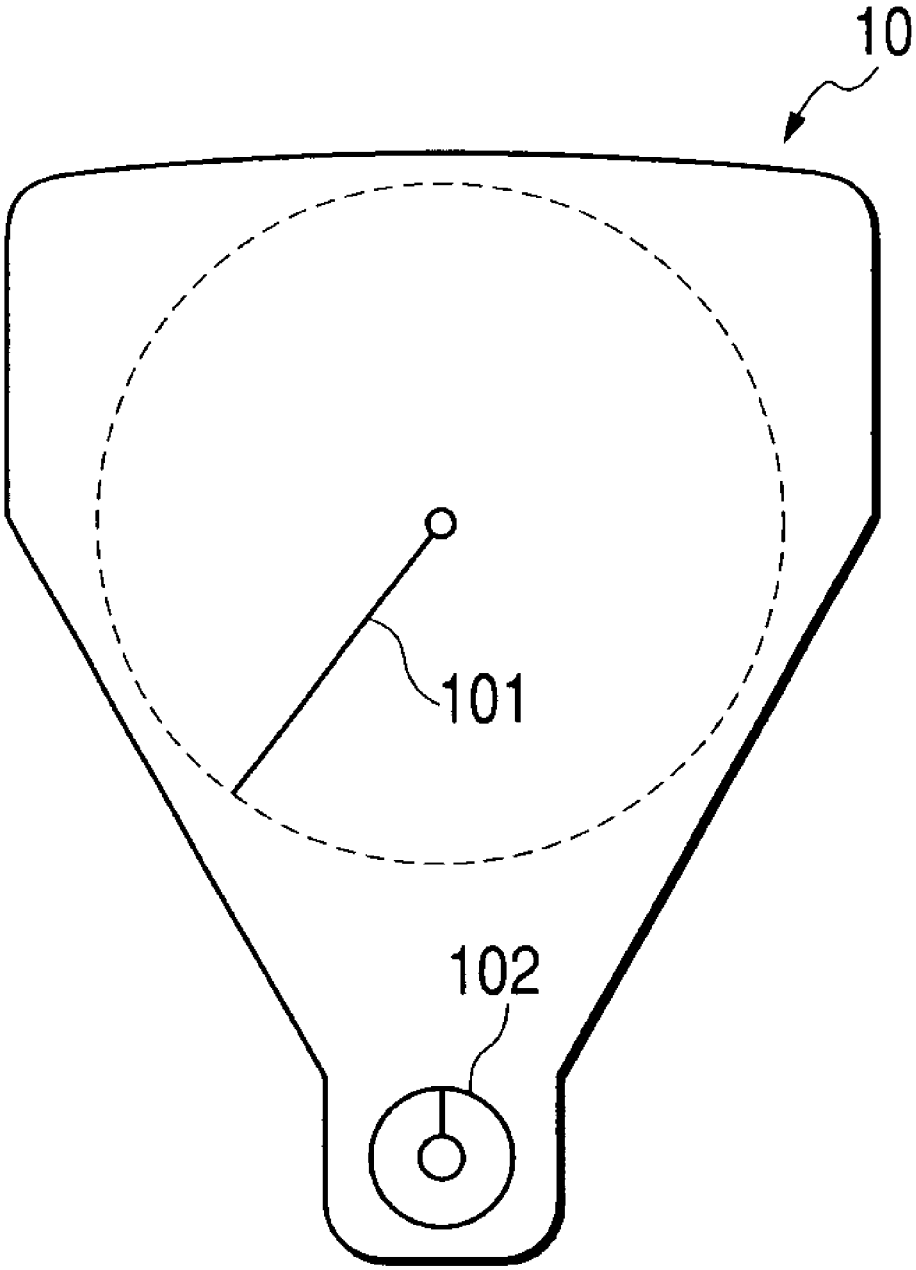
FIG. 8 is a schematic cross-sectional view of a developer supplying container.
Figure 9:
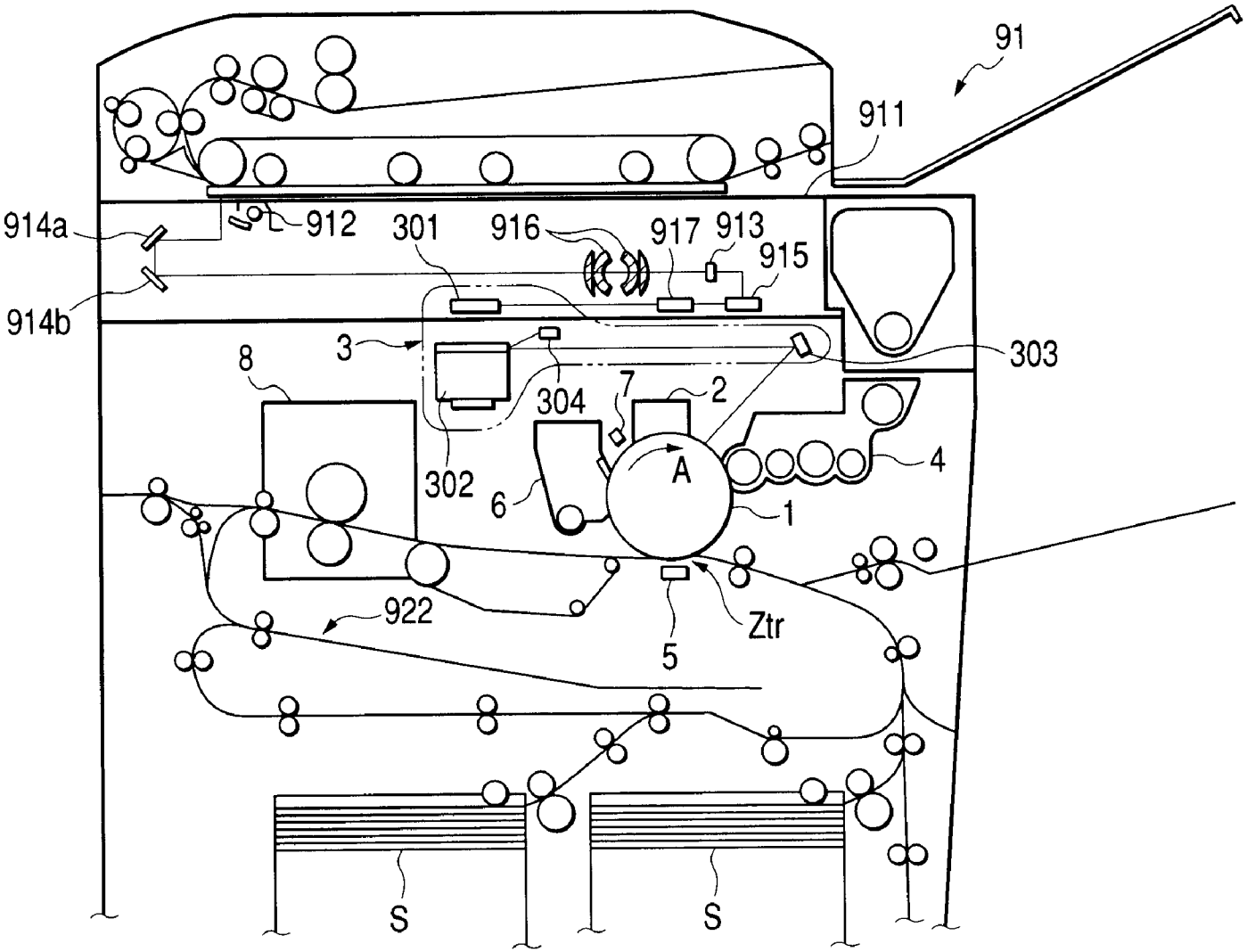
FIG. 9 is a schematic cross-sectional view of essential portions of a conventional image forming apparatus.

The developer is supplied to users or the like in a state of being packed in a resin container 10 incorporating agitating and transporting members 101 and 102 (see FIG. 8). About 1700 g of the developer is packed in the container 10.

Under an instruction for interchanging the developer container in the image forming apparatus, the user or the like replaces the empty container 10 loaded in a first developer supplying device with a new one filled with the developer, thereby supplying the toner to the image forming apparatus.

When the new container 10 filled with the developer is loaded into the first developer supplying device, the developer is discharged through an output formed in an inner end portion of the container 10 to flow into the toner buffer container 47 through an inlet formed in an inner end portion of the toner buffer container 47.

In a case where an a-Si drum is used as an image bearing member in a high-speed machine, as in this embodiment, a flexible sheet heater 12 is incorporated in the a-Si drum for the purpose of preventing occurrence of a smeared image at the time of startup and compensating for a temperature characteristic of the a-Si to stabilize the developing performance.

If the development sleeve 41 is made of stainless steel, its tendency to deform by heat from the heater 12 is increased since the thermal conductivity of stainless steel is low. Therefore it is preferable to use as the development sleeve material an aluminum alloy having high thermal conductivity and less thermally deformable by heat from the drum heater. However, aluminum alloys are inferior in wear resistance than stainless steel.

As a method for improving the wear resistance, a method of coating the surface of an aluminum alloy with a resin or a method of coating the surface of an aluminum alloy with a metal plating layer may be used. In this embodiment, the former is used.

Figure 2:
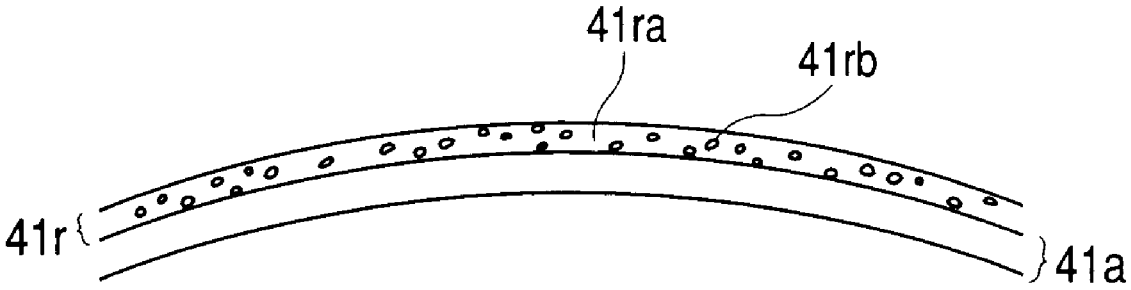
FIG. 2 is a schematic cross-sectional view of a developer bearing member in a first embodiment of the present invention.

A resin coating layer 41*r* is formed on the peripheral surface of a cylindrical base member 41*a* or the like made of an aluminum alloy. The resin coating layer 41*r* is a layer of a resin composition containing a phenolic resin as a binder resin. An electroconductive material 41*ra* is dispersed in the resin coating layer 41*r*. In some case, a solid lubricant 41*rb* may be contained together with the electroconductive material 41*ra*, as shown in FIG. 2.

The inventors of the present invention earnestly made studies about the structure of the coating layer 41*r* formed on the surface of the developer bearing member and found that if a phenolic resin containing quaternary ammonium salt compound which itself is positively chargeable with respect to iron powder is used as a binder resin for forming the coating, the positively-triboelectrifying property of the binder resin itself can be improved to retain a larger amount of charge on the positively chargeable toner and to contribute to prevention of occurrence of an excessive amount of charge on a part of the developer and strong attachment of the developer to the developer bearing member, which can be realized by using an electroconductive material and, if necessary, a solid lubricant. In the developer bearing member formed as described above, the mechanical strength and wear resistance of the coating layer itself can be improved. Therefore the developer bearing member has long-term durability and makes it possible to provide good images with improved stability during a longer time period in comparison with, for example, the case where particles having a charging property are added to the developer to improve the charging performance.

It is difficult to ascertain the reason why the resin coating layer becomes a material capable of suitably charging the positively chargeable toner if it is formed by using, as a (binder) resin used to form an electroconductive resin (coating) layer on the surface of the developer bearing member, a phenolic resin containing a quaternary ammonium salt compound which itself is positively chargeable relative to iron powder. However, the following explanation may be given.

That is, in the case where a quaternary ammonium salt compound which is used in this embodiment and which itself is positively chargeable with respect to iron powder is used in, for example, the resin coating layer, it is uniformly dispersed in the phenolic resin when added in to the phenolic resin and is easily taken into the structure of the phenolic resin when the resin is heated and set to form the coating layer. Simultaneously, the original structure of quaternary ammonium salt having positive polarity is lost and the phenolic resin into which the quaternary ammonium salt compound has been taken becomes sufficiently chargeable negatively and uniformly, that is, the phenolic resin itself, having the above-described chemical composition, becomes easily chargeable with the polarity opposite to that of the positively chargeable developer, so that the positively chargeable developer can be suitably charged if the developer bearing member having a coating layer of the above-described material is used.

Any quaternary ammonium salt compound may suffice as one having the above-described function and suitably used in this embodiment if it is positively chargeable relative to iron powder. For example, a quaternary ammonium salt compound expressed by the following general formula (A) may be used.

(A)

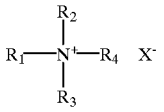

(where each of $R_1$, $R_2$, $R_3$, and $R_4$ represents one of an alkyl group which may have a substituent, an aryl group which may have a substituent, and an aralkyl group which may have a substituent, groups R1 to R4 may be same or different from each other, and $X^-$ represents a negative ion.)

An ion favorably used as negative ion $X^-$ in the general formula A is, for example, an organic sulfuric acid ion, an organic sulfonic acid ion, an organic phosphoric acid ion, a molybdic acid ion, a tungstic acid ion, or a heteropoly acid ion including a molybdenum atom or a tungsten atom.

The resin coating was formed by a procedure described below.

Materials shown below were mixed and zirconia particles having a diameter of 2 mm were added as a filler to the mixture, followed by dispersion in a sand mill for 3 hours. The zirconia particles were thereafter removed by sieve, and the solid content was adjusted to 30% by using isopropanol, thereby obtaining, in a polyamide resin, a resin composition to which a quaternary ammonium salt compound positively chargeable with respect to iron powder was added.

| | |
|---|---|
| Carbon | 20 parts by mass |
| Graphite | 80 parts by mass |
| Phenolic resin (solid content: 50%) | 500 parts by mass |
| Quaternary ammonium salt compound expressed by the following formula | 75 parts by mass |
| Methanol | 150 parts by mass |
| Carbon particle (diameter: 5 μm) | 70 parts by mass |

(1)

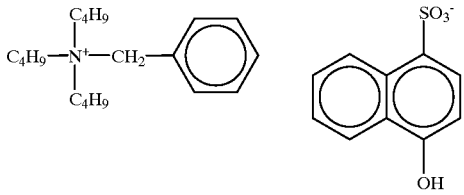

The amount of triboelectrification with iron powder of the quaternary ammonium salt compound expressed by the above equation (1) was measured on the basis of a blow-off method by using a triboelectrification amount measuring device, a model TB-200 (trademark, a product by Toshiba Chemical Corp.). The polarity of the measured triboelectric charge was positive.

The resin compound was obtained as a coating material, the composition of which was C(carbon)/G(graphite)/B (phenolic resin)/CA(quaternary ammonium salt compound)/PC(carbon particles)=0.2/0.8/2.5/0.75/0.7. The obtained resin compound was applied on an insulating sheet with a bar coater and was heated and set. The sheet was cut by a predetermined size and the volume resistivity of the coating film was measured with a low resistivity meter, LORESTA (trademark, a product by Mitsubishi Petrochemical Co.). The measured volume resistivity was 1.9×10 Ω·cm.

The resin composition was then applied by spraying on an aluminum cylindrical member having a diameter of 32.3 mm, thereby forming a coating film having a thickness of 15 to 20 μm. The coating was heated at 150° C. for 30 minutes to be set and was finished with sand paper so as to have a predetermined surface roughness.

A stationary permanent magnet roller 44 having six magnetic poles is provided in the development sleeve 41. The development sleeve 41 is rotated at a speed Vdahm higher than the peripheral moving speed of the photosensitive drum 1, 450 mm/sec (image forming speed) by a drive motor provided as a drive means (see FIG. 3).

In this embodiment, the thickness of the toner layer is regulated by the regulating blade 42 made of a magnetic metal, and a gap G1 is set to 240 μm. Under this condition, the toner existing between the development sleeve and the regulating blade rubs against the development sleeve and the regulating blade.

An atmospheric enviroment sensor 951 is provided as a means for sensing the atomspheric environment around the devices in the forming apparatus. The sensor 951 has a humidity sensor chip and a temperature sensor chip mounted on a glass-epoxy base plate. The sensor chips are connected to conductors on the base plate by gold wires. The humidity sensor chip has a silicon substrate on which a thin film of titanium nitride (TiN) formed to provide a heater with a silicon oxide film interposed between the substrate and the titanium nitride film. A humidity sensor provided as a humidity detecting means is formed on the heater with a film of silicon oxide ($SiO_2$) interposed therebetween as an insulating layer. The humidity sensor is realized by forming a lower electrode formed of a platinum thin film, a moisture sensitive film formed of a polyimide film, and an upper electrode formed of gold disposed thereon. A change in the capacitance across the moisture sensitive film is extracted through the lower and upper electrodes.

A temperature sensor chip is placed on the sensor head base plate spaced apart from the humidity sensor chip. The temperature sensor chip has a silicon substrate on which a temperature sensor provided as a temperature detecting means is formed with an insulating film interposed therebetween.

Figure 15:
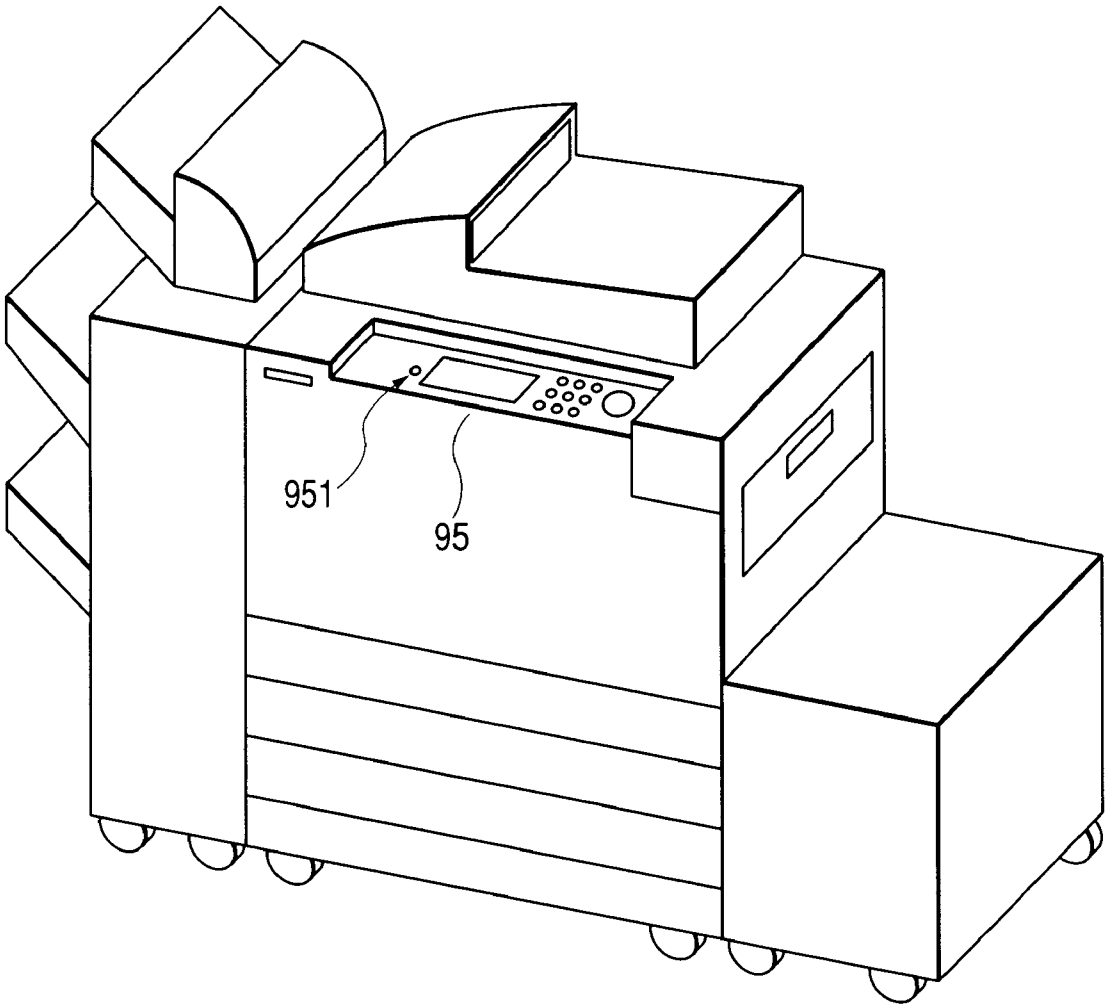
FIG. 15 is a schematic perspective view of the image forming apparatus representing the first embodiment of the present invention.

The environment sensor 951 is mounted on a lower portion of an operating panel 95 of the image forming apparatus (see FIG. 15). However, this portion is not exclusively selected for placement of the environment sensor 951. It is important to select for the sensor a place where the range of variation in temperature is smallest by considering the construction of the image forming apparatus.

Figure 10:
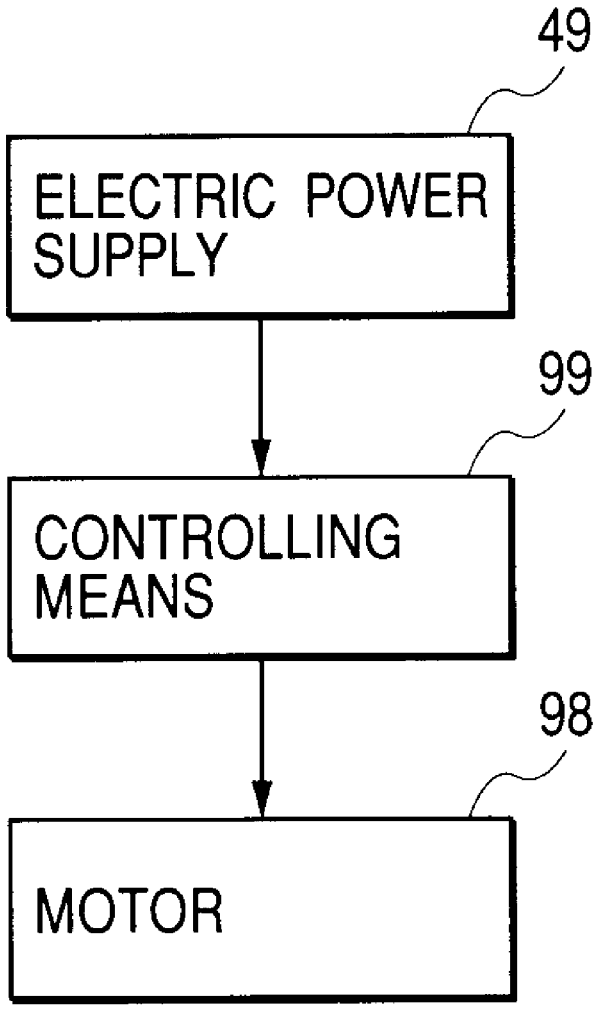
FIG. 10 is a diagram for explaining control.
Figure 11:
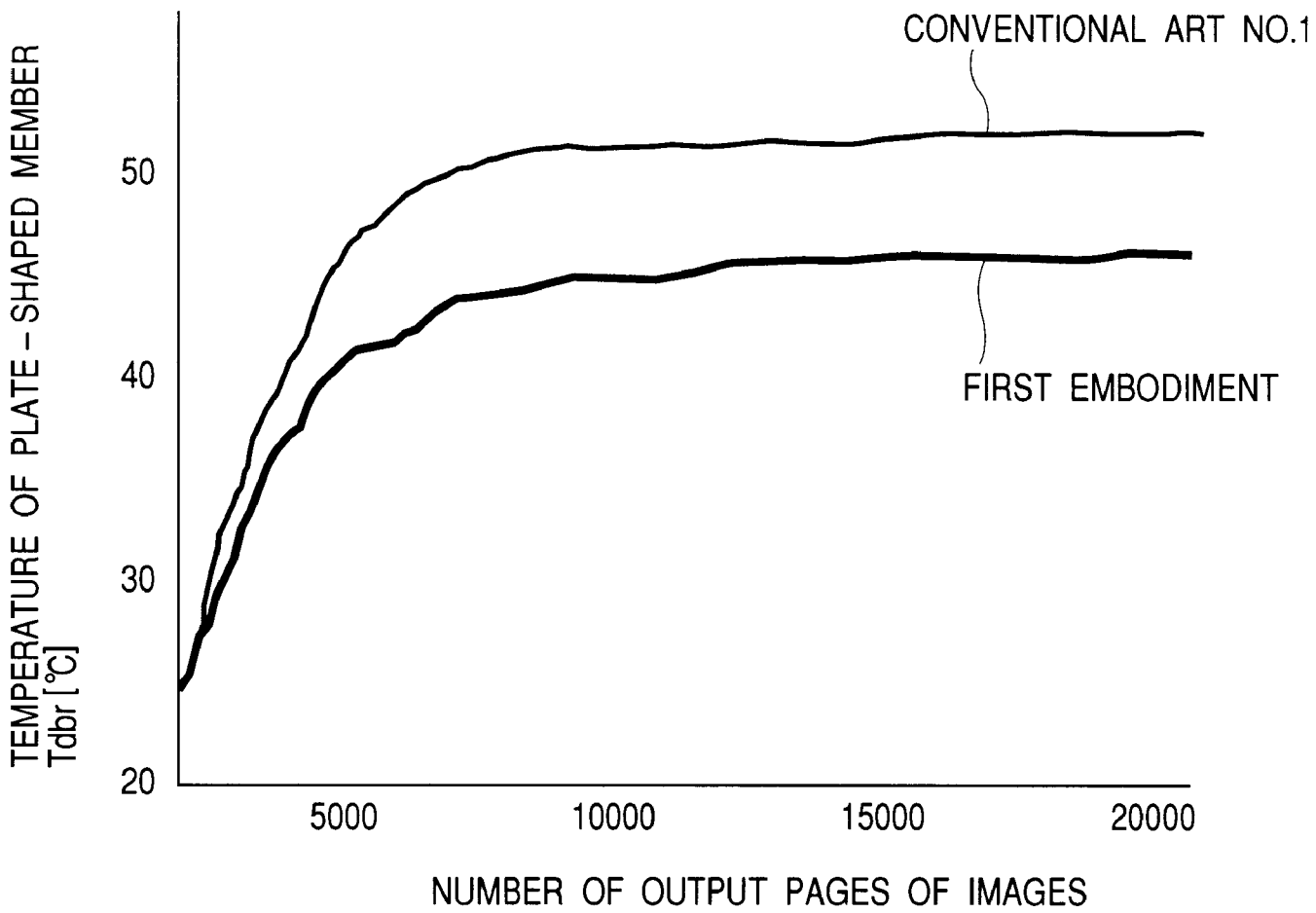
FIG. 11 is a diagram showing changes in temperature in the vicinity of the developing device in comparison between the conventional art and the embodiment of the present invention.
Figure 12:
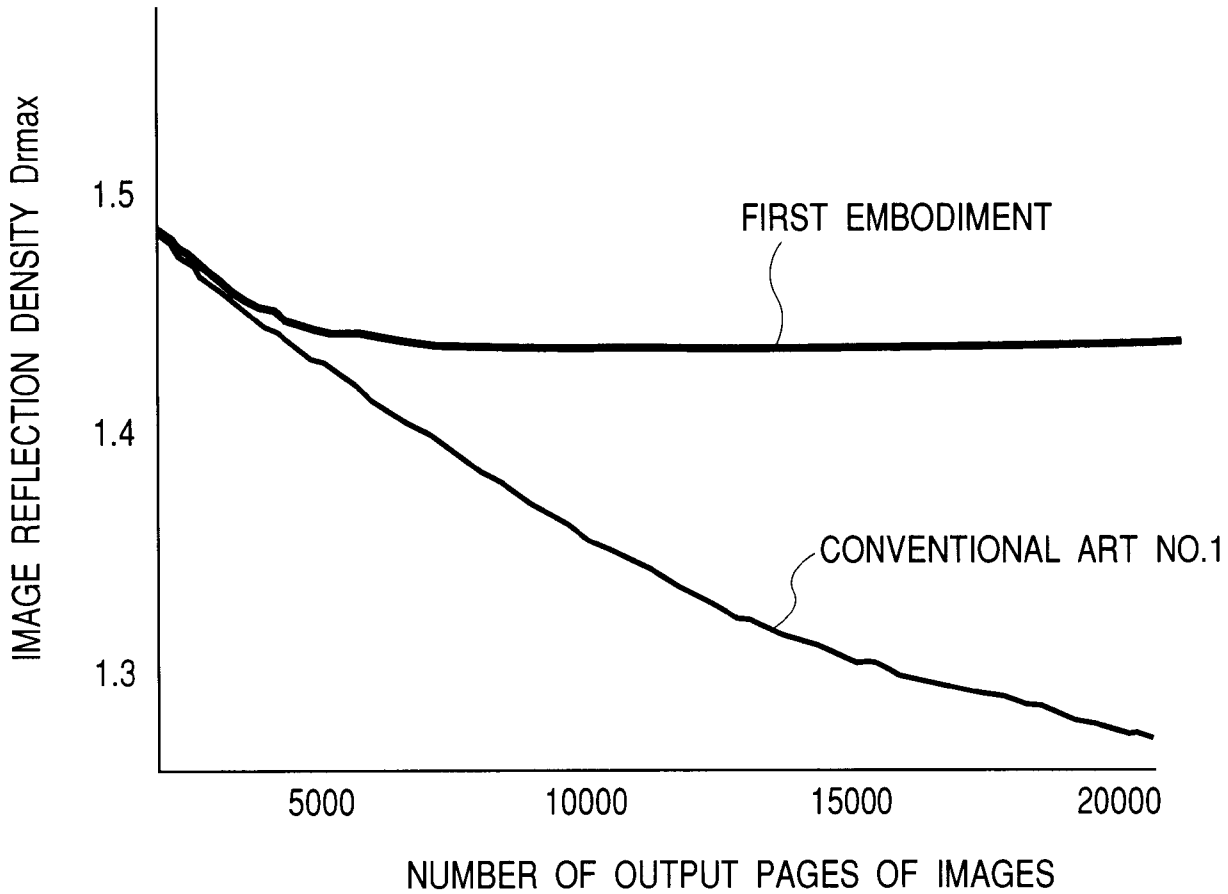
FIG. 12 is a diagram showing changes in image reflection density in comparison between the conventional art and the embodiment of the present invention.
Figure 13:
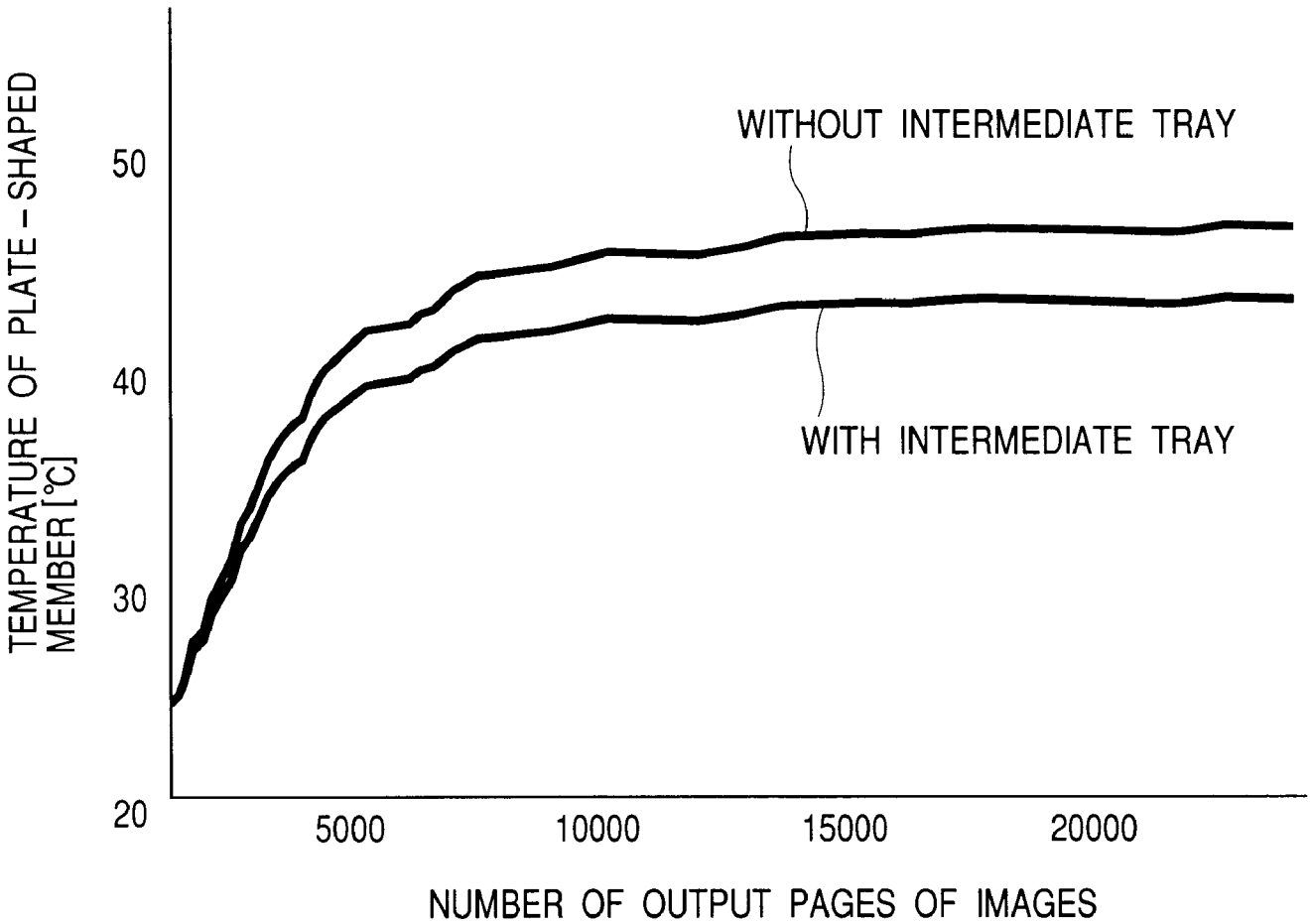
FIG. 13 is a diagram showing changes in temperature in the vicinity of the developing device relating to the existence/nonexistence of an intermediate tray.
Figure 14:
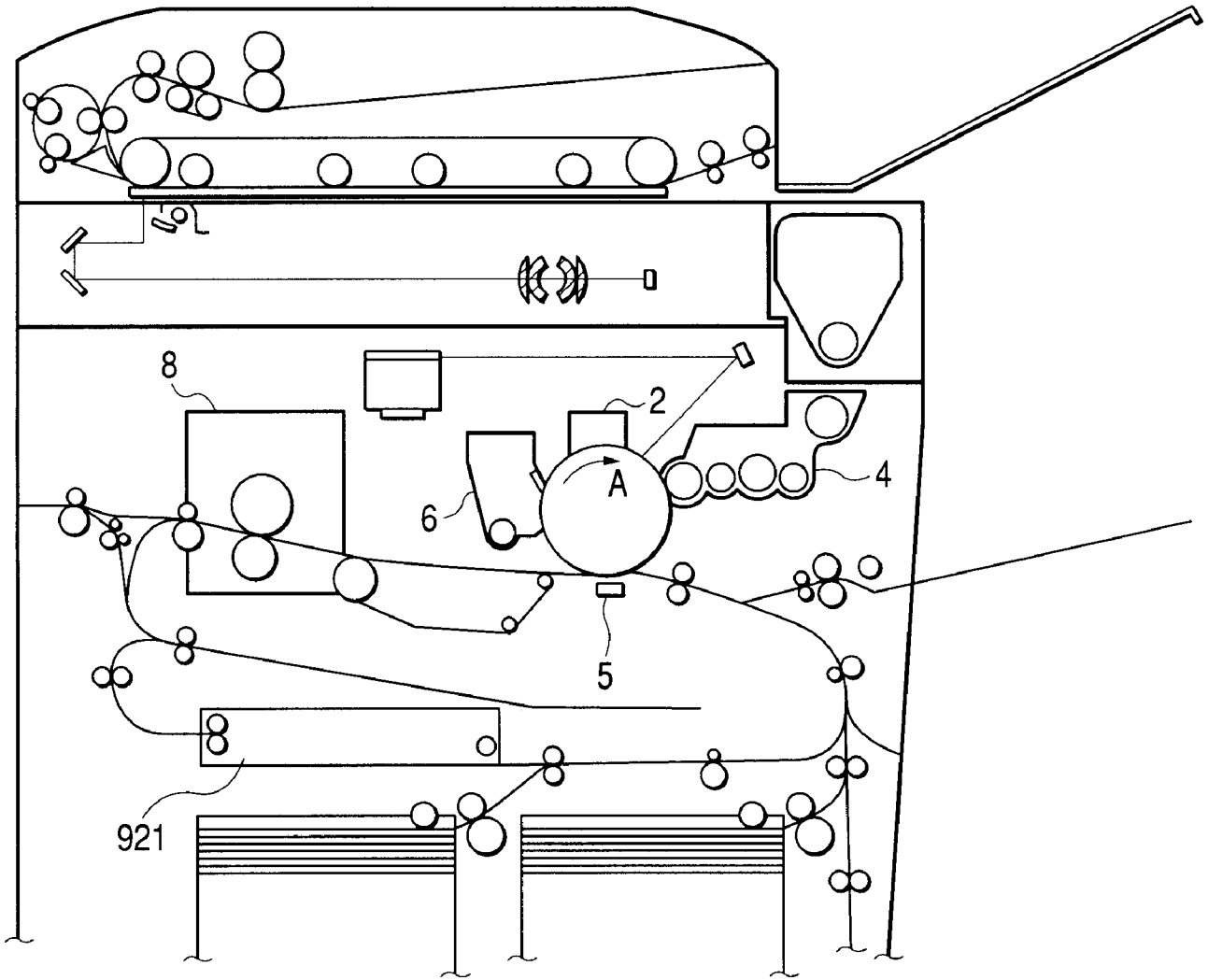
FIG. 14 is a schematic cross-sectional view of a conventional image forming apparatus.

A signal relating to the absolute water amount ηaw produced by the environment sensor 951 is supplied to a control means 99 via several electrical circuits (not shown) along with information on a job to be executed (a set of instructions for forming images, for example, "to form, on two surfaces of recording medium paper sheets from the middle tray of the feed cassette, a 50% reduced image of an original placed on the original feeder at a comparatively low density in a character/photograph mixture mode, and to thereby output 100 copies of the original in such a state that the copy sheets have their one upper left portions stapled). The control means 99 controls, through several electrical circuits (not shown), energizing of a motor 98 provided as a means for driving the development sleeve 41, thereby controlling Vdahm (see FIG. 10).

The peripheral speed of the photosensitive drum is set to 450 mm/sec regardless of whether the one-side mode or the two-side modes is selected.

The control means 99 then selects one of the image forming modes according to a printing instruction input to the image forming apparatus (e.g., in the case of a copying machine, information input through a liquid crystal display section in an upper portion of the image forming apparatus, or in the case of a printer, information supplied from a computer connected to the image forming apparatus through a network cable), and controls the motor 98 according to the selected mode, thereby controlling the peripheral speed of the development sleeve.

More specifically, this speed control is performed as shown in Table 2.

TABLE 2

| Absolute water amount (g/kg) | Mode | Vdahm |
|---|---|---|
| 20≦ | Two-side continuous | 580.5 |
| <20 | | 787.5 |
| Entire range | Others | |

That is, for example, when a job is given to perform copying in the two-side mode using the through-path system in an environment where the temperature is 30° C. and the humidity is 80% RH, Vdahm=580.5 mm/sec is selected since the absolute water amount ηaw is 21.56 g/kg.

"Continuous" in Table 2 and in the following description denotes outputting 1000 pages or more by one job.

In the above-mentioned environment, when a job is given to perform copying in the one-side mode, Vdahm=787.5 mm/sec is selected.

In an environment where the temperature is 20° C. and the humidity is 15% RH, Vdahm=787.5 mm/sec is therefore selected no matter what a given job may be since the absolute water amount ηaw is 2.16 g/kg.

In a case where two-side copying on one paper sheet is intermittently performed, the development sleeve peripheral speed may be reduced relative to that at the time of one-side copying. In this case, the speed control may be such that the criterion of determination as to whether the development sleeve peripheral speed at the time of two-side copying is reduced relative to that at the time of one-side copying according to the atmospheric environment (the absolute humidity in the atmosphere) and the rate at which the speed of development sleeve is reduced at the time of two-side copying are variable.

Figure 4:
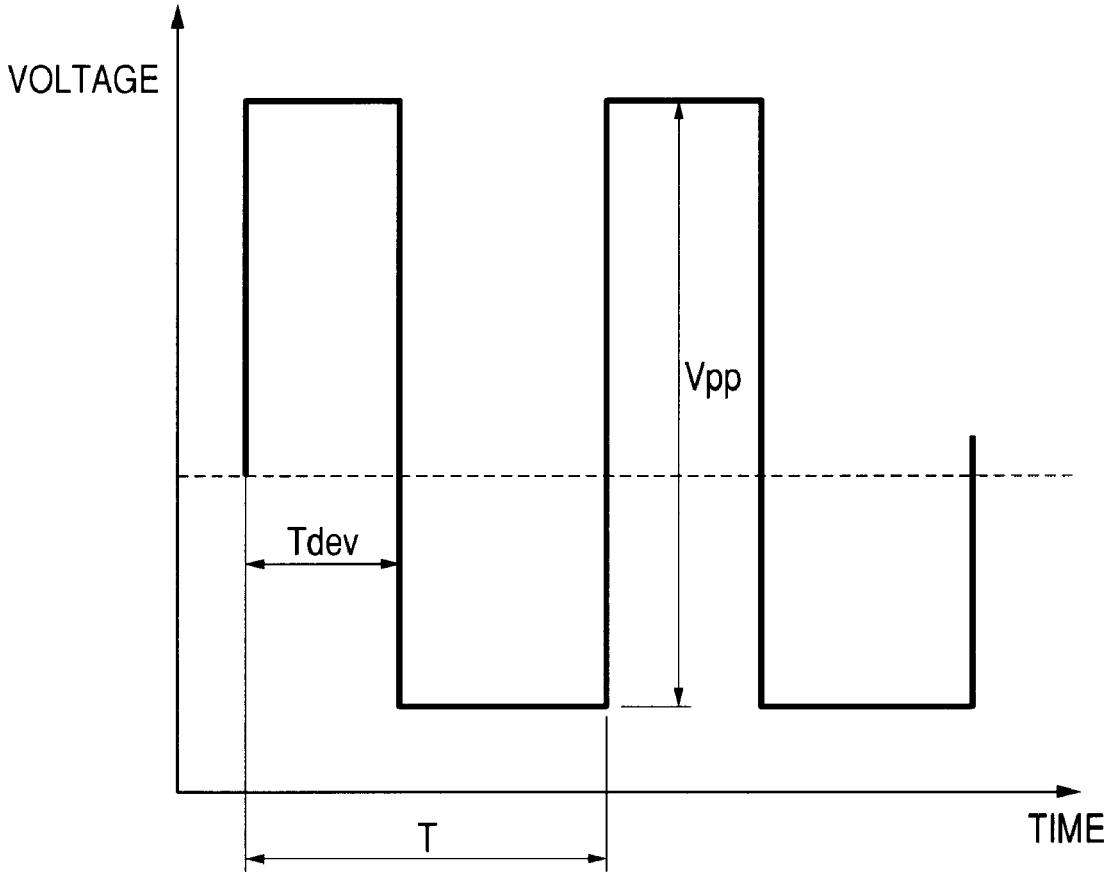
FIG. 4 is a diagram for explaining a development bias in the first embodiment of the present invention.

The gap G2 between the development sleeve 41 and the photosensitive drum 1 is set to 215 μm and a development bias generated by superimposing a dc voltage Vm=280 V on an ac voltage having an amplitude Vpp=1000 V, a frequency f=1/T=2.7 kHz, and a duty ratio ηdevac=Tdev/T=0.4 is applied to the development sleeve. The ac bias waveform is as shown in FIG. 4. The development contrast Vdev (the difference between the exposed portion potential (light portion) and the development bias) is 230 V and the fogging removal contrast Vdef (the difference between the unexposed portion potential (dark portion) and the development bias) is 120 V.

Tables 3 and 4 show the performance of the image forming apparatus of this embodiment after one million pages with A4-size images of a standard image proportion (6%) had been continuously output in a high-temperature and high-humidity environment.

TABLE 3

| | | | After two-side continuous printing of one million A4 pages | | |
|---|---|---|---|---|---|
| Temperature (C.) | Humidity (% RH) | Absolute water amount (g/kg) | Drmax | Fogging (%) | Dark stripe(s) in sheet feed direction |
| 32 | 90 | 27.43 | 1.2 | 2 | Several faintish |
| 30 | 80 | 21.56 | 1.3 | 2 | One faintish |
| 28 | 80 | 19.13 | 1.35 | 1.5 | None |
| 27 | 75 | 16.86 | 1.38 | 1 | None |
| 30 | 50 | 13.3 | 1.42 | 1 | None |
| 25 | 60 | 11.89 | 1.43 | 0.5 | None |
| 23 | 50 | 8.74 | 1.45 | 0.5 | None |
| 30 | 20 | 5.25 | 1.48 | 1 | None |
| 20 | 15 | 2.16 | 1.5 | 1.5 | None |
| 15 | 5 | 0.52 | 1.5 | 2 | None |

TABLE 4

| | After two-side continuous printing of one million A4 pages | | |
|---|---|---|---|
| | Drmax | Fogging (%) | Dark stripe(s) in sheet feed direction |
| Embodiment 1 of Invention | 1.3 | 2 | Several faintish |
| Embodiment 2 of Invention | 1.25 | 1.5 | One faintish |
| Embodiment 3 of Invention | 1.33 | 1.5 | One faintish |
| Embodiment 4 of Invention | 1.33 | 1.0 | One faintish |
| Conventional Art 1 | 0.98 | 5 | Several ten noticeable |
| Conventional Art 2 | 1.05 | 3 | Several noticeable |
| Conventional Art 3 | 1.1 | 3.5 | Several noticeable |

As can be understood from these results, the image quality stabilizing effect of the present invention is significantly higher than that of conventional art 1 because the effect of limiting toner degradation by reducing the development sleeve peripheral speed in the two-side mode relative to that in the one-side mode prevails over the effect of reducing the amount of toner passing through the development section per unit time by reducing the difference between the peripheral speeds of the photosensitive drum and the development sleeve.

EMBODIMENT 2

A second embodiment of the present invention will now be described.

Figure 5:
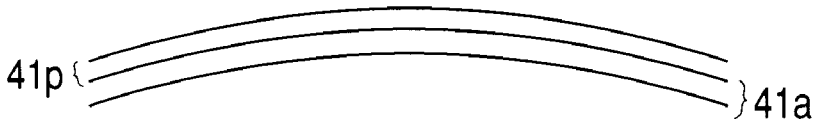
FIG. 5 is a schematic cross-sectional view of a developer bearing member in a second embodiment of the present invention.
Figure 6:
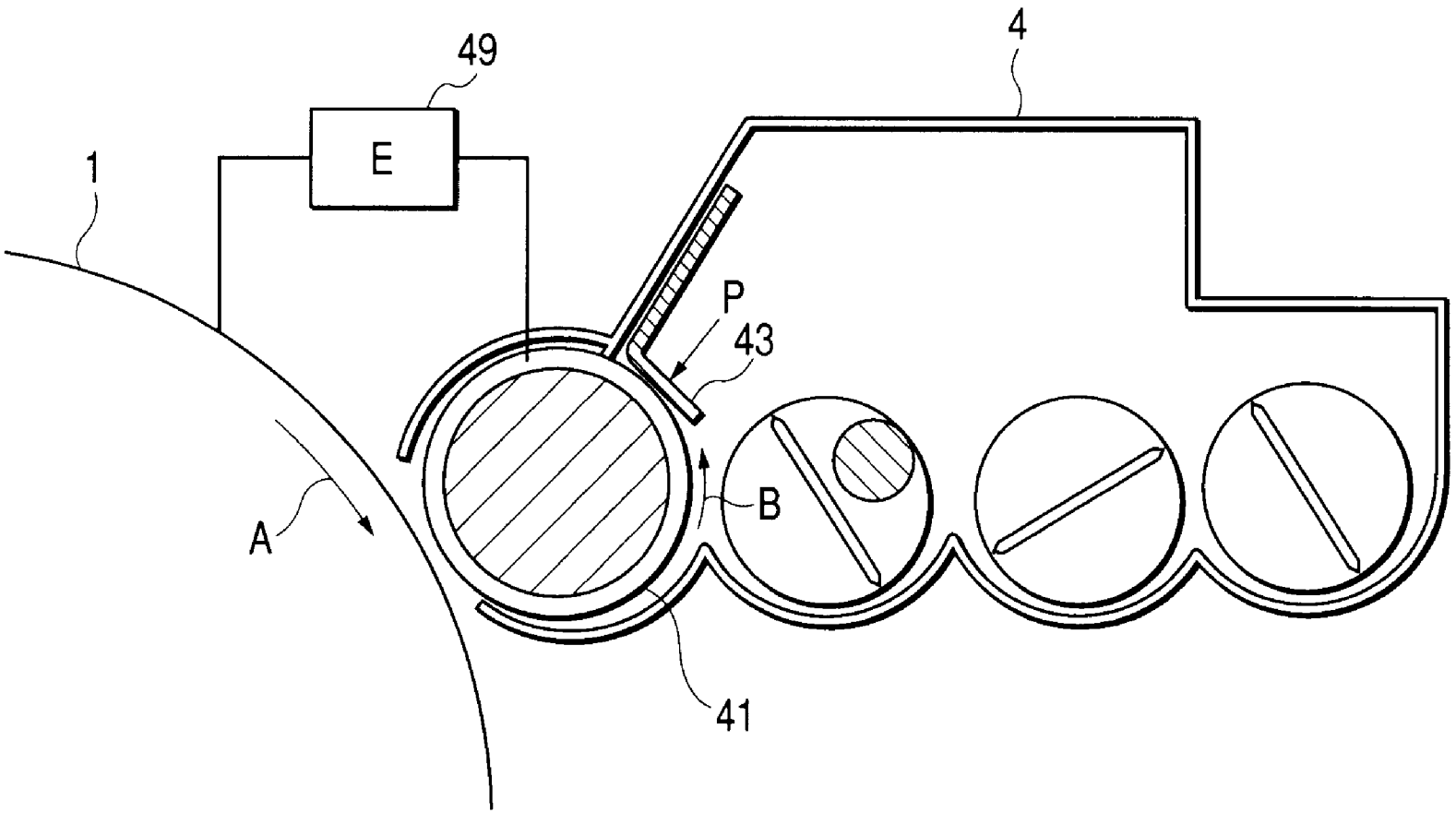
FIG. 6 is a schematic cross-sectional view of a conventional developing device.
Figure 7:
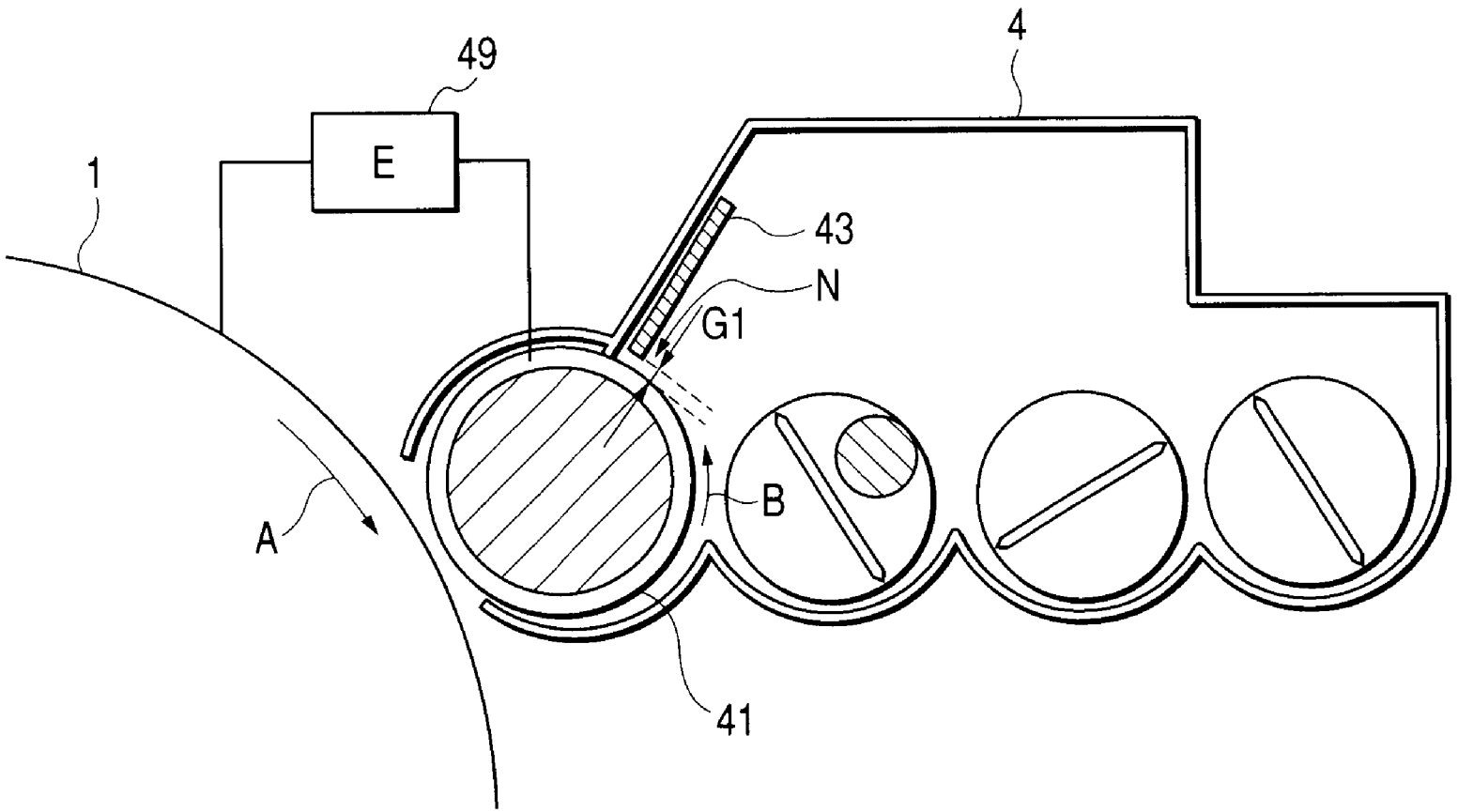
FIG. 7 is a schematic cross-sectional view of a conventional developing device.

The second embodiment differs from the first embodiment in that a metal plating layer 41*p* is formed on the surface of the cylindrical base member 41*a* forming a developing sleeve base layer (see FIG. 5). In other respects, the second embodiment is the same as the first embodiment. The description for the same details will not be repeated.

From various kinds of plating for surface hardening, not electroplating but electroless plating is used in this embodiment. For example, as electroless plating of a nonmagnetic metal, electroless Ni—P plating, electroless Ni—B plating and electroless Cr plating are preferred.

While as mentioned above the development sleeve 41 is made nonmagnetic to enable use of magnetic toner, a small magnetic force of the metal plating on the surface of the development sleeve is allowable in practice since the thickness of the plating layer is small, several microns. However, a nonmagnetic plating is preferred. Nickel (Ni) is, singly, a ferromagnetic material but becomes amorphous and nonmagnetic when combined with phosphorus (P) or boron (B) in electroless Ni—P plating layer or electroless Ni—B plating layer. The phosphorus content in electroless Ni—P plating film required to make nickel nonmagnetic is 8 to 10 wt % and the boron content in electroless Ni—B plating film required to make nickel nonmagnetic is 5 to 7 wt %.

The entire surface of the development sleeve 41 may be uniformly plated or a mesh-like plating having openings freely shaped may be formed. A mesh-like plating can be obtained by performing plating after masking using a mesh-like pattern. A zincate treatment, often performed to improve the adhesion between a plating film and a development sleeve surface, may be performed to form a zinc alloy coating film on the development sleeve surface before plating.

The reason for using electroless plating instead of electroplating in this embodiment is because electroless plating enables precipitated plating metal to be attached to the roughened surface of the development sleeve 41 having irregularities so as to be uniform in thickness without being influenced by the irregularities, and because substantially the same surface roughness as that obtained by roughening can be thereby maintained. In the case of elecroplating, plating metal cannot precipitate easily in cavities or grooves in the roughened surface of the development sleeve and is attached first to projections to increase the thickness of plating film particularly largely on the projections, resulting in failure to obtain a plating film uniform in thickness, i.e., failure to maintain the surface roughness.

Table 4 shows the performance of the image forming apparatus of this embodiment after one million pages with A4-size images of a standard image proportion (6%) had been continuously output in a high-temperature and high-humidity environment. As can be understood from Table 4, the image quality stabilizing effect in this embodiment is significantly higher than that of conventional art 2 because the effect of limiting toner degradation by reducing the sleeve speed prevails over the effect of reducing the amount of toner passing through the development section per unit time, as in the first embodiment.

EMBODIMENT 3

A third embodiment of the present invention will now be described.

The third embodiment differs from the first embodiment in that the sleeve speed Vdahm is controlled more finely according to the absolute water amount ηaw in the surrounding atmosphere. In other respects, the third embodiment is the same as the first embodiment. The description for the same details will not be repeated.

That is, criteria of control of Vdahm are set more finely, as shown in Table 5. The larger the absolute water amount ηaw, the lower the sleeve speed Vdahm.

TABLE 5

| Absolute water amount (g/kg) | Mode | Vdahm |
|---|---|---|
| 25< | Two-side | 580.5 |
| 22< ≦25 | continuous | 630 |
| 18< ≦22 | | 675 |
| 10< ≦18 | | 720 |
| ≦10 | | 787.5 |
| 20≦ | One-side | 720 |
| <20 | continuous | 787.5 |
| Entire range | Others | |

For example, when a job is given to perform continuous copying in the two-side mode in an environment where the temperature is 30° C. and the humidity is 80% RH, Vdahm=675 mm/sec is selected since the absolute water amount ηaw is 21.56 g/kg.

In this environment, when a job is given to perform continuous copying in the one-side mode, Vdahm=720 mm/sec is selected.

In an environment where the temperature is 25° C. and the humidity is 60% RH, when a job is given to perform continuous copying in the two-side mode, Vdahm=720 mm/sec is selected since the absolute water amount ηaw is 11.89 g/kg.

In this environment, when a job is given to perform continuous copying in the one-side mode, Vdahm=787.5 mm/sec is selected.

Whenever a job other than continuous copying jobs is given, Vdahm=787.5 mm/sec is selected.

In some cases, when two-side copying on one paper sheet is intermittently performed, the development sleeve peripheral speed may be reduced relative to that at the time of one-side copying. In such a case, the speed control may be such that the criteria of determination as to whether the development sleeve peripheral speed at the time of two-side copying is reduced relative to that at the time of one-side copying according to the atmospheric environment (the absolute humidity in the atmosphere) and the rate at which the speed of development sleeve is reduced at the time of two-side copying are variable.

Table 4 shows the performance of the image forming apparatus of this embodiment after one million pages with A4-size images of a standard image proportion (6%) had been continuously output in a high-temperature and high-humidity environment. As can be understood from Table 4, the image quality stabilizing effect in this embodiment is significantly higher than that of conventional art 3 because the effect of limiting toner degradation by reducing the sleeve speed prevails over the effect of reducing the amount of toner passing through the development section per unit time, as in the first and second embodiments.

EMBODIMENT 4

A fourth embodiment of the present invention will now be described.

The fourth embodiment differs from the third embodiment in that a surrounding atmosphere temperature Tenv is included in control criteria in addition to the absolute water amount ηaw in the surrounding atmosphere. In other respects, the fourth embodiment is the same as the third embodiment. The description for the same details will not be repeated.

That is, criteria of control of Vdahm are set more finely, as shown in Table 6.

TABLE 6

| Temperature (° C.) | Humidity (% RH) | Absolute water amount (g/kg) | Vdahm | Mode |
|---|---|---|---|---|
| 26 | 100 | 21.34 | 787.5 | Two- |
| 27 | 95 | 21.51 | 675 | side |
| 28 | 89 | 21.36 | | |
| 29 | 84 | 21.36 | | |
| 30 | 80 | 21.56 | | |
| 31 | 75 | 21.39 | 630 | |
| 32 | 71 | 21.44 | | |
| 33 | 67 | 21.4 | | |
| 34 | 64 | 21.62 | 580.5 | |
| 35 | 60 | 21.42 | | |

For example, the absolute water amount in an environment where the temperature is 30° C. and the humidity is 80% RH and the absolute water amount ηaw in an environment where the temperature is 35° C. and the humidity is 60% RH are approximately equal to each other. However, the influence of the latter environment on the developing device is larger since the temperature is higher. By considering this fact, control criteria including reference to temperatures are prepared, as shown in Table 6. In this manner, the effects of control can also be improved with respect to cases where the temperature rises while the absolute water amount is constant.

Table 4 shows the performance of the image forming apparatus of this embodiment after one million pages with A4-size images of a standard image proportion (6%) had been continuously output in a high-temperature and high-humidity environment. The image forming apparatus of this embodiment was tested in an environment where the temperature varied between 27° C. and 33° C. and the humidity varied between 60% and 80%.

As can be understood from Table 4, the image quality stabilizing effect based on the phenomenon in which the effect of limiting toner degradation by reducing the sleeve speed prevails over the effect of reducing the amount of toner passing through the development section per unit time can be reliably obtained even in such an unstable environment.

The present invention have been described with respect to the embodiments thereof. "Conventional art N" (N: integer) referred to above is an image forming apparatus which corresponds to "Embodiment N" but in which the sleeve speed is not controlled, that is, the sleeve speed is constant. The technical scope of the present invention is not limited to the described embodiments of the present invention.

That is, the developing device comprises one in which a magnetic field generating means provided inside a developer bearing member rotates together with the developer bearing member, one in which two or more developer bearing members are provided in one developing unit, one having a cylindrical developer layer forming member, one using a two-component developer composed of toner and a carrier, one using a developer composed only of nonmagnetic toner, one in which a developer bearing member contacts an image bearing means, and one using a developer bearing member in the form of a belt.

The peripheral speed of the developer bearing member may be set to any value between a low and high speeds.

The developer layer thickness regulating member is not limited to the noncontact type of regulating member that does not contact the developer bearing member, and a contact type of regulating member made of an elastic material may alternatively be used, as mentioned above.

The control means 99, to which information from the environment sensor 951 is input along with a job for copying in the two-side mode, may receive information from environment sensor 951 after recognizing a two-side mode job, and may change the peripheral speed Vdahmby the two-side mode job only.

The sleeve speed control may be performed more finely, and the value of the absolute water amount at which the sleeve speed is changed may be changed. Also, the number of environment sensors may be increased and the places in which the sensors are mounted may be changed. It is desirable to optimize these factors according to the characteristics of the image forming apparatus.

In other words, it is to be construed that all changes and modifications, which may be considered small changes from the viewpoint of the gist of the present invention, belong to the technical scope of the present invention.

According to the first to fourth embodiments, as described above, it is possible to provide an image forming apparatus in which deterioration in quality of output images due to a temperature rise in the image forming apparatus and moisture absorption into the developer can be prevented, and which can output high-quality images with stability during a long time period.

In particular, even in a case where images are continuously output at a high speed in a high-temperature and high-humidity environment where the temperature and humidity change largely, deterioration in quality of the output images due to an increase in the temperature of the developing device, an increase in the temperature in the image forming apparatus constituted by the developing device and moisture absorption into the developer can be prevented.

What is claimed is:

1. An image forming apparatus comprising:

a developer bearing member for bearing and transporting a developer to develop a latent image formed on an image bearing member;

regulating means for regulating a thickness of a layer of the developer borne on said developer bearing member;

fixing means for fixing a developer image on a recording medium transferred from said image bearing member, wherein one of a first mode in which a developer image is formed only on one side of the recording medium and a second mode in which developer images are formed on two sides of the recording medium can be selected; and changing means for changing a peripheral speed of said developer bearing member according to a selected mode.

2. An apparatus according to claim 1, wherein a peripheral speed of said developer bearing member when the second mode is selected is lower than a peripheral speed of said developer bearing member when said first mode is selected.

3. An apparatus according to claim 1 or 2, wherein, in the second mode, developer images are successively formed on a recording medium on which a developer image is not formed and a recording medium on which a developer image has been fixed by said fixing means.

4. An apparatus according to claim 3, wherein said changing means changes the peripheral speed of said developer bearing member in the second mode according to an atomspheric environment.

5. An apparatus according to claim 4, wherein the atmospheric environment comprises temperature and humidity.

6. An apparatus according to claim 4, wherein the atmospheric environment comprises an absolute amount of water.

7. An apparatus according to claim 3, wherein said regulating means rubs against the developer borne on said developer bearing member.

8. An apparatus according to claim 3, wherein said developer bearing member comprises a base member and a resin layer formed on said base member.

9. An apparatus according to claim 3, wherein said fixing means heats the developer image and the recording medium.

10. An apparatus according to claim 3, wherein the developer comprises a one-component magnetic toner.

11. An image forming apparatus comprising:

a developer bearing member for bearing and transporting a developer to develop a latent image formed on an image bearing member;

regulating means for regulating a thickness of a layer of the developer borne on said developer bearing member;

fixing means for fixing a developer image on a recording medium transferred from said image bearing member, wherein one of a first mode in which a developer image is formed only on one side of the recording medium and a second mode in which developer images are formed on two sides of the recording medium can be selected; and determination means for determining, in accordance with an atomspheric enviroment, whether a peripheral speed of said developer bearing member in the second mode should be differentiated from a peripheral speed of said developer bearing member in the first mode.

12. An apparatus according to claim 11, wherein said determination means determines, in accordance with the atmospheric environment, whether the peripheral speed of said developer bearing member in the second mode should be lowered relative to the peripheral speed of said developer bearing member in the first mode.

13. An apparatus according to claim 12, wherein the peripheral speed of said developer bearing member in the second mode is determined in accordance with the atmospheric environment.

14. An apparatus according to claim 11, wherein the peripheral speed of said developer bearing member in the first mode is determined in accordance with the atmospheric environment.

15. An apparatus according to any one of claims 11 to 14, wherein, in the second mode, developer images are successively formed on a recording medium on which a developer image is not formed and a recording medium on which a developer image has been fixed by said fixing means.

16. An apparatus according to claim 15, wherein the atmospheric environment comprises temperature and humidity.

17. An apparatus according to claim 15, wherein the atmospheric environment comprises an absolute amount of water.

18. An apparatus according to claim 15, wherein said regulating means rubs against the developer borne on said developer bearing member.

19. An apparatus according to claim 15, wherein said developer bearing member comprises a base member and a resin layer formed on the base member.

20. An apparatus according to claim 15, wherein said fixing means heats the developer image and the recording medium.

21. An apparatus according to claim 15, wherein the developer comprises a one-component magnetic toner.

* * * * *

UNITED STATES PATENT AND TRADEMARK OFFICE

CERTIFICATE OF CORRECTION

PATENT NO. : 6,493,522 B2
DATED : December 10, 2002
INVENTOR(S) : Hideki Fujita

It is certified that error appears in the above-identified patent and that said Letters Patent is hereby corrected as shown below:

Column 6,
Line 65, “a them” should read -- of them --.

Column 7,
Line 45, “f*f*” should read -- fθ --.

Column 8,
Line 6, “pm.” should read -- $\mu$m. --.

Column 11,
Line 33, “atomspheric” should read -- atmospheric --.

Column 17,
Line 65, “atomspheric” should read -- atmospheric --.

Column 18,
Line 27, “atomspheric” should read -- atmospheric --.

Signed and Sealed this

Ninth Day of September, 2003

JAMES E. ROGAN
*Director of the United States Patent and Trademark Office*